United States Patent [19]

Knickerbocker

[11] 4,252,507

[45] Feb. 24, 1981

[54] HAND-ACTUATABLE PUMP ASSEMBLY

[75] Inventor: Michael G. Knickerbocker, Crystal Lake, Ill.

[73] Assignee: Seaquist Valve Company, Cary, Ill.

[21] Appl. No.: 74,233

[22] Filed: Sep. 10, 1979

[51] Int. Cl.[3] ..... F04B 39/08; F04B 21/02

[52] U.S. Cl. ..... 417/444; 417/550; 222/321

[58] Field of Search ..... 417/443, 444, 550, 552; 222/321

[56] References Cited

U.S. PATENT DOCUMENTS

| | | | |
|---|---|---|---|
| 2,909,123 | 10/1959 | Jennings, Jr. | 417/444 |
| 4,010,874 | 3/1977 | Steiman | 222/321 |
| 4,050,860 | 9/1977 | Beres | 417/444 |
| 4,155,489 | 5/1979 | Steiman | 222/321 |

*Primary Examiner*—William L. Freeh

*Attorney, Agent, or Firm*—Dressler, Goldsmith, Shore, Sutker & Milnamow, Ltd.

[57] ABSTRACT

An improved, hand actuatable pump assembly. A stem and piston assembly extend into a valve body. The piston sealingly engages the wall of the valve body and together they define a pressure chamber therebelow. The piston seals a discharge passageway in the stem. As the pump assembly is primed, air in the pressure chamber escapes through the discharge passageway. When the pump is ready for use, the force of hydraulic pressure below the piston opens communication between the pressure chamber and passageway. When the piston nears the end of the stroke, it is mechanically held open to complete dispensing. At all times, a positive seal between the piston and the valve body wall is maintained to prevent passage of the contents of the pressure chamber therebetween, thereby to minimize sticking and clogging of the pump assembly.

8 Claims, 3 Drawing Figures

HAND-ACTUATABLE PUMP ASSEMBLY

BACKGROUND OF THE INVENTION

A number of products, such as window sprays, deodorants, starches, hand lotions, hair sprays and the like are available in dispensers of the pump type. A variety of pump dispensers are currently available, and a number of such devices are illustrated in U.S. Pat., such as U.S. Pat. Nos., 3,463,093, 3,680,790, 3,406,909, 3,796,375, 3,500,760, 3,774,849, 3,627,206 and 4,082,222.

One such device, of the type shown in U.S. Pat. No., 3,463,093 has met with substantial acceptance. However, the cost of its manufacture and the tendency of certain of its parts to become clogged and to stick as it is used have been drawbacks in its use on occasion.

Thus, there remains a need for improved pumps which are more effective and which minimize clogging and sticking, as well as pumps which are more efficiently and effectively manufactured. The pump of this invention provides a number of such advantages.

SUMMARY OF THE INVENTION

This invention relates to an improved pump construction which minimizes the sticking and clogging which is sometimes characteristic of pumps, such as those made in accordance with U.S. Pat. No., 3,463,093.

In particular, it relates to a hand actuatable pump assembly adapted to be secured to the mouth of a container for dispensing material in the container. The pump assembly includes a closure securable to the container, an elongate stem defining an axially extending passageway and a spray button defining a spray orifice. The stem is slidably supported in a valve body which is secured to the closure. The valve body defines an interior pressure chamber adapted to contain material to be dispensed through the spray orifice.

In a first upper position, to which the stem is urged by a spring in the valve body, the stem passageway is closed off from communication with the valve body interior or pressure chamber by an elongate piston. The piston surrounds and seals against the stem above and below a laterally extending opening which communicates with the passageway. The piston also seals against the interior wall of the valve body to define the pressure chamber therebelow.

In use, as the stem and associated piston move downwardly, the hydraulic pressure developed forces material in the pressure chamber between the piston and stem, hence into the passageway and out the spray orifice. When the lower sealing lip of the piston engages an abutment, such as a shelf surface formed in the interior of the valve body, that tends to distort the piston and mechanically unseats the piston from its sealing engagement with the stem sufficiently to maintain the pressure chamber in communication with the passageway and spray orifice. No liquid passes between the piston and wall of the valve body. When the stem is released the spring and piston suitably restore the stem to its upper position and the pressure chamber is refilled via the unseating of a ball or check valve at the base of the valve body.

BRIEF DESCRIPTION OF THE DRAWINGS

Further objects, features and advantages of the present invention will appear from the following description and drawings of a presently preferred embodiment, of which

DESCRIPTION OF THE PREFERRED EMBODIMENT

Figure 1:
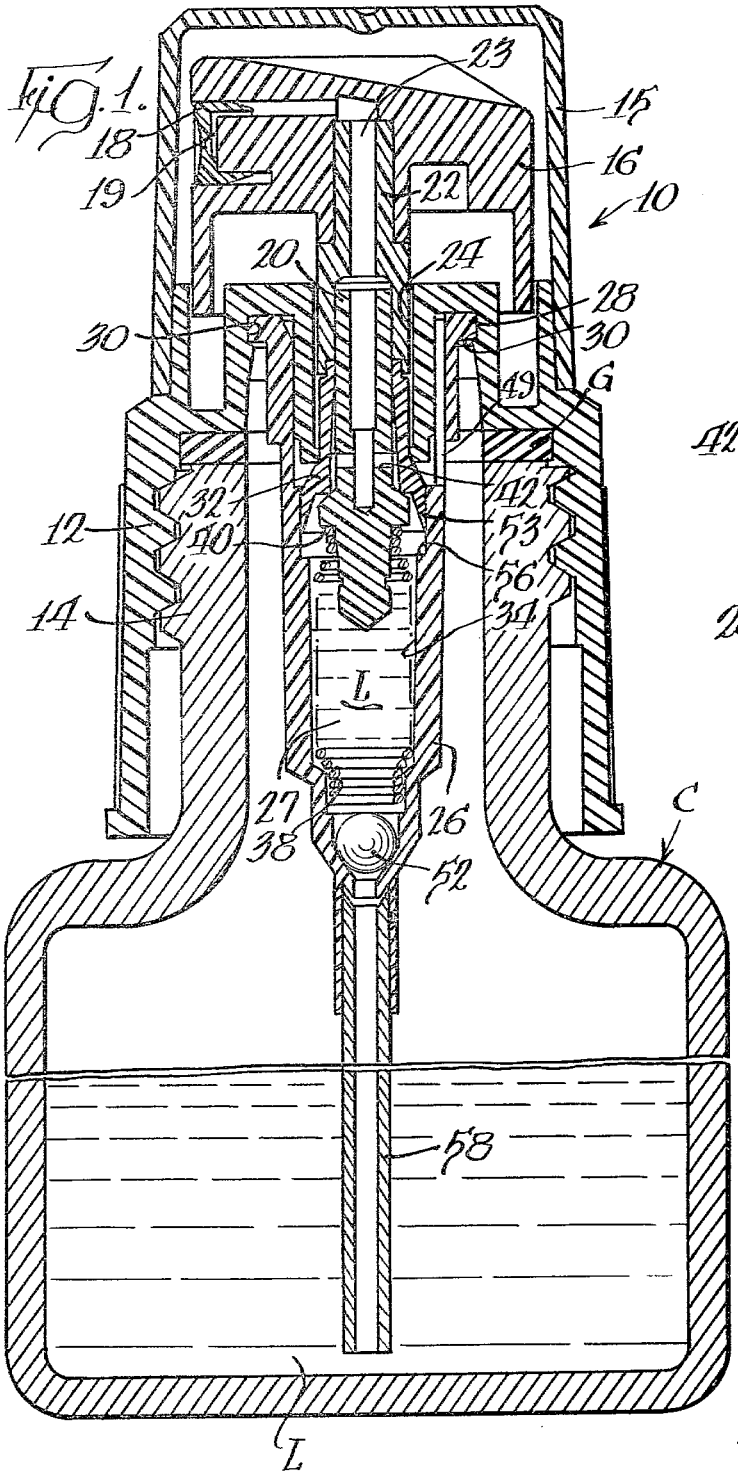
FIG. 1 is a cross-sectional view of a pump assembly of this invention as affixed to a container.

Referring now to the drawings, a presently preferred embodiment of the present invention comprises a hand-actuatable pump assembly 10 adapted to be secured to a container C such as a bottle. Container C contains material to be dispensed, such as a deodorant, starch, hair spray or the like. Assembly 10 includes a threaded closure 12 threadedly and sealingly secured to the threaded neck 14 of container C. Gasket G seals the mouth of the neck to closure 12. Closure 12 and container C may be fabricated of suitable plastic materials.

Assembly 10 further comprises a spray member or button 16 defining a cavity in which a spray insert 18 providing a discharge opening, such as a spray orifice 19, is provided. The insert and orifice may be configured to develop a suitable spray pattern for the material to be dispensed in accordance with principles known in the art. A protective hood 15 is removably seated on closure 12 to overlie spray button 16.

Spray button 16 is seated on a stem which, in the embodiment illustrated, comprises an elongate cylindrical stem member 20 and an adapter 22. Adapter 22 is snuggly seated in a tubular recess defined by the spray button and is sealingly seated on the upper end of stem member 20. Together they define a continuous, axially extending passageway 23 through which material to be dispensed is adapted to pass to the spray orifice for discharge.

Figure 2:
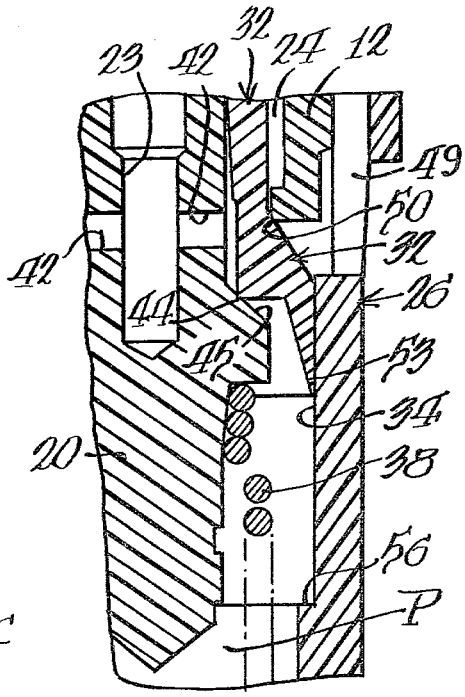
FIG. 2 is an enlarged fragmentary cross-sectional view of FIG. 1, in the upper non-dispensing or rest position.
Figure 3:
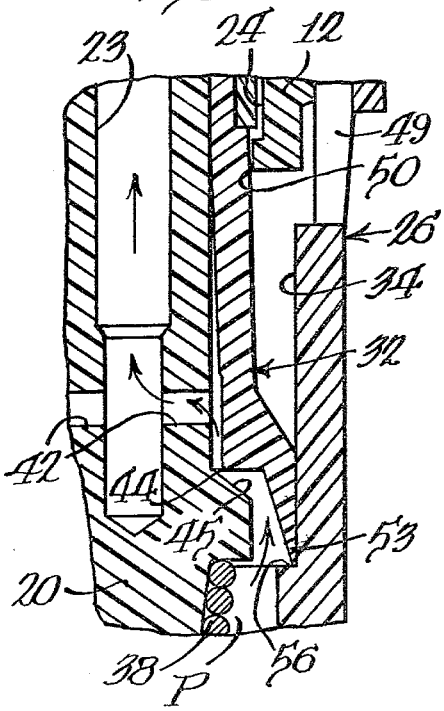
FIG. 3 is an enlarged fragmentary cross-sectional view similar to FIG. 2, but in a lower dispensing position.

The stem is reciprocably and slidably movable in a tubular opening 24 defined by closure 12 so that it is guided longitudinally as it moves from its upper position of rest, as shown in FIGS. 1 and 2, to lower dispensing positions such as is shown in FIG. 3.

The pump assembly includes a valve body 26 which is secured via an upper shoulder segment 28 in an annular recess 30 in closure 12. The valve body defines an interior pressure chamber 27 for containing material to be dispensed through the spray orifice. An elongate piston 32, preferably of an elastic material such as polyethylene or rubber, resiliently and sealingly secured at its upper end to the stem, extends downwardly and has a lower lip portion 53 which continuously and sealingly engages the inner wall 34 of body 26 above the pressure chamber for a purpose to be described. The piston maintains a positive seal at all times between it and the wall 34 thereby preventing the passage of material from the pressure chamber therebetween. The stem is biased into the upper position of FIGS. 1 and 2 by a spring 38. Spring 38 bears against a lower inner portion of the body 26 and against a shoulder 40 defined by a lower portion of the stem.

Stem member 20 defines the passageway 23 referred to above. The passageway 23 terminates downwardly in at least one laterally or radially extending opening 42. That provides communication between the axially extending passageway 23 and with the pressure chamber 27 of the body 26 when the pump assembly is actuated. In the upper position of rest shown in FIGS. 1 and 2, the annular sealing segment 44 of piston 32 sealingly bears against the stem below openings 42, thereby closing off communication between openings 42 and passageway 23, on the one hand, and the pressure chamber 27 on the other hand. However, under conditions of use to be described, as illustrated in FIG. 3, openings 42 communicate with the body interior between sealing segment 44 and the confronting stem surface 45, thereby to permit the material, such as the liquid L in the pressure chamber, to be dispensed to be forced outwardly through passageway 23 and spray orifice 19.

When assembled, the pump assembly is "leak proof." It is sealed against spillage by the piston, both by the annular sealing segment 44 and by the sealing engagement of the piston with the tubular opening 24 in the closure, as at 50, thereby to prevent leakage of the material in the interior of the container through tubular opening 24.

When the consumer first uses the pump assembly, it is necessary to prime the pump, i.e., to vent the air trapped in the body interior and to permit the pressure chamber 27 to become filled with the liquid L to be dispensed. To that end the user pushes the spray button downwardly. This firmly and sealingly seats the ball valve 52 against a lower portion of the body interior, thereby permitting the air in the valve body below the piston, i.e., the air in the pressure chamber P, to become somewhat compressed. As the piston moves downwardly in the body, compression increases. Then, the piston sealing lip 53, which sealingly engages the interior wall of the body, engages an abutment, such as a shelf surface or shoulder 56 defined by the interior wall of the body 26. This, as downward movement continues, unseats the piston sealing segment 44 from stem member sealing surface 45, places the pressure chamber in communication with the spray orifice 19 and permits air to escape through openings 42, through passageway 23 and then through spray orifice 19.

When the spray button 16 is released and rises under the restoring influence of spring 38, the ball valve 52, under the influence of the negative pressure developed in the pressure chamber becomes unseated, and liquid rises through dip tube 58, which is connected to the lower portion of the body 26. The liquid passes under and around ball valve 52 and partially fills the interior of the body 26. Several repeated cycles eventually result in the filling of the body with liquid to be dispensed and the elimination of air from the pressure chamber. As the priming continues, on the third or fourth stroke some dispensing of contained material will occur. Thereafter, the assembly is ready for dispensing.

As liquid is withdrawn from the container C, a negative pressure would tend to develop if venting did not occur. Therefore, to maintain atmospheric pressure in the container, ambient air is permitted to replace withdrawn liquid. As such, the container interior communicates with ambient atmosphere through one or more vent apertures 49 which are in communication with the tubular opening 24 when the seal at 50 is broken. This occurs on the downstroke to admit air as shown by FIG. 3. Preferably three such vent apertures 49 are provided at 120° intervals around the periphery of the valve body 26.

After priming, dispensing will occur upon further strokes in predetermined quantities and in the pattern provided for by the spray insert and orifice.

As a liquid dispensing stroke commences, pressure is generated in the valve body pressure chamber below the piston. As the stroke continues, hydraulic pressure is developed sufficient to force liquid between the piston segment 44 and stem sealing surface 45, thus beginning the dispensing cycle. As the stroke continues, dispensing continues until the sealing lip 53 engages shoulder 56, and as the downward movement continues further, for perhaps another 10 thousandths of an inch, dispensing continues until the downward movement stops entirely. At that time, the spray orifice 19 remains open to communiction with the pressure chamber. It is to be observed that at all times the sealing lip 53 remains in sealing engagement with the interior wall 34 of the valve body. Accordingly, there is no blow-by of liquid into pockets or other recesses in the pump assembly which might become clogged or which might ultimately stick as tends to occur with pumps of the type illustrated in U.S. Pat. No. 3,463,093.

When the spray button 16 is released, lip 53 moves away from shoulder 56 (while remaining in sealing engagement with the interior wall 34), the sealing segment 44 again sealingly seats on stem member sealing surface 45 thereby to close off passageway 23 from communication with the valve body interior. The ball 52 rises in response to the negative pressure generated in the body interior, and the pressure chamber again fills. Further, the seal at 50 is again provided to make the assembly "leakproof" once again. On the next downstroke, the ball valve 52 is again seated so the cycle of pressurizing, dispensing and refilling may again occur.

As compared to pumps of the type illustrated in U.S. Pat. No. 3,463,093, clogging and sticking is minimized. The use of pockets in such devices which permit the expansion of the piston to create a pressure drop and to stop dispensing in such prior art constructions depends upon the pockets remaining open and free of deposits. This also means that liquid can pass upwardly between the piston lip and body wall, and into the area of the tubular opening 24. If the recesses fill wholly or partially with material, or if the liquid is carried upward into the vent aperture zone and into the zone between the stem and closure, sticking is promoted, for as the material dries out, it tends to leave deposits which result in sticking and clogging, thereby interferring with free sliding movement of the stem, with effective venting and with the proper designed length of stroke. All of this interferes then with the proper operation of the pump and impedes proper discharge by the pump.

To the contrary, in accordance with the present invention no pockets or recesses are used, hence there are no pockets which can produce clogging or which permit bypassing of liquid upwardly past the piston lip. Rather, the pump assembly 10 provides for a positive mechanical opening of the discharge passageway near the conclusion of the dispensing stroke by providing the abutting shoulder 56 which mechanically serves to lift the lip mechanically to maintain communication between the pressure chamber and the spray orifice, thereby to conclude the dispensing cycle and to permit pressure to become equalized in the pressure chamber.

Thus, the assembly of this invention also tends to minimize movement of liquid upwardly between the piston and the valve body 26 which occurs with devices made in accordance with U.S. Pat. No. 3,463,093, thereby minimizing the depositing of materials contained in the liquid in the container which contribute to sticking, hence interference with effective use of the dispenser.

Accordingly, the pump assembly of this invention provides for positive, sure dispensing.

Not only is the pump assembly more consistently effective than other pumps, but it is also simpler to make. Constructions requiring pockets such as those disclosed in U.S. Pat. No. 3,463,093 require the use of special molding techniques and more complicated molds than those required to make the valve bodies of the present invention. Further, the positive mechanical opening of the discharge passageway permits greater tolerance in the parts and molds.

It will be apparent to those skilled in the art that modifications may be made in the structure of the illustrated preferred embodiment without departing from the spirit and scope of the present invention. Accordingly it is not intended that the invention herein shall be limited except in accordance with the claims.

What is claimed is:

1. A hand-actuatable pump assembly adapted to be sealingly secured to the mouth of a container for dispensing material in the container, comprising a spray member defining a discharge opening, an elongate stem means defining a discharge passageway communicating with said discharge opening, an elongated valve body defining an interior pressure chamber for containing material to be dispensed through said discharge opening, said stem means extending into said valve body and being reciprocably movable in said valve body from an upper position to lower dispensing positions, piston means secured to said stem means and being sealingly seated thereon to close off said passageway from said body interior in said upper position, said piston means being in sealing engagement with said valve body above said pressure chamber to prevent material in said pressure chamber from passing between said piston means and said valve body, abutment means in said pressure chamber and positioned to engage said piston means as said piston means is moved downwardly from said upper position to a lower dispensing position to hold open said passageway thereby to maintain communication between said passageway and said valve body pressure chamber while preventing passage of material between the piston and the valve body interior above the piston.

2. A hand-actuatable pump assembly in accordance with claim 1 in which said abutment means is a shoulder comprising a shelf surface for engaging said piston means.

3. A hand-actuatable pump assembly in accordance with claim 2 in which said valve body defines a valve seat near its base, and further comprising a ball valve overlying said valve seat adapted to be in sealing engagement with said valve seat when said stem means is moved downwardly from said upper position thereby to define said pressure chamber, and a dip tube extending downwardly from said valve body.

4. A hand-actuatable pump assembly in accordance with claim 2 in which said piston means is elongate and defines a downwardly extending lip portion confronting said shelf surface, said shelf surface, when said lip is forced downwardly thereagainst, causing said piston means to become mechanically unseated to maintain communication between said passageway and said pressure chamber.

5. A hand actuatable pump assembly in accordance with claim 4 in which said discharge passageway extends axially of said stem means and terminates downwardly in at least one lateral opening, and in which said piston means sealingly engages said stem means both above and below said lateral opening thereby to close off said passageway in said upper position.

6. A hand-actuatable pump assembly adapted to be sealingly secured to the mouth of a container for dispensing material in the container, comprising a closure securable to a container, a spray button defining a spray orifice, an elongate stem defining an axially extending passageway communicating with said spray orifice, an elongate valve body secured to said closure, said valve body defining a pressure chamber for containing material to be dispensed through said discharge opening, said stem being slidably mounted on said pump assembly and extending into said valve body and being slidable in said valve body from an upper position to lower dispensing positions, spring means for urging said stem toward said upper position, a piston secured to said stem, said piston being elongate and sealingly engaging said stem to close off said passageway from said pressure chamber and sealingly engaging the interior wall of said valve body in all positions of stem movement, thereby to define said pressure chamber in said body below said piston, to prevent passage of material from said pressure chamber upwardly between said interior wall and said piston in all positions of the piston, and to permit the contents of said pressure chamber hydraulically to open up communication between said passageway and said pressure chamber as said stem is moved downwardly from said upper position, and abutment means on the interior wall of said body positioned to engage said piston as the piston moves to lower dispensing positions to mechanically unseat said piston, thereby mechanically to maintain communication between said passageway and said pressure chamber until said stem is allowed to return to said upper position.

7. A hand-actuatable pump assembly in accordance with claim 6 in which said piston comprises a lip confronting said abutment means, said lip being positioned to engage said abutment means as said piston is moved towards lower dispensing positions.

8. A hand-actuatable pump assembly in accordance with claim 7 in which said passageway terminates downwardly in a lateral opening, and said piston sealingly engages said stem above and below said lateral opening when said stem is in said upper position, and in which said sealing engagement below said lateral opening is broken under the influence of hydraulic pressure as said stem is moved downwardly.

* * * * *